US007910860B2

(12) United States Patent
Irvin

(10) Patent No.: US 7,910,860 B2
(45) Date of Patent: Mar. 22, 2011

(54) FLUID WARMER

(76) Inventor: Daniel Irvin, Muncie, IN (US)

( * ) Notice: Subject to any disclaimer, the term of this patent is extended or adjusted under 35 U.S.C. 154(b) by 430 days.

(21) Appl. No.: 12/026,805

(22) Filed: Feb. 6, 2008

(65) Prior Publication Data

US 2008/0185371 A1 Aug. 7, 2008

Related U.S. Application Data

(60) Provisional application No. 60/888,457, filed on Feb. 6, 2007.

(51) Int. Cl.
*F27B 5/14* (2006.01)
*F28F 7/00* (2006.01)

(52) U.S. Cl. ..... 219/390; 219/385; 219/433; 219/201; 219/202; 219/429; 219/528; 219/259; 219/387; 219/549

(58) Field of Classification Search ..... 219/390, 219/385, 382, 201–202, 429, 432, 433, 528–529, 219/387, 549
See application file for complete search history.

(56) References Cited

U.S. PATENT DOCUMENTS

| | | | | |
|---|---|---|---|---|
| 3,434,302 | A | 3/1969 | Stoner et al. | |
| 4,793,149 | A | 12/1988 | Riche | |
| 4,889,302 | A | 12/1989 | Tucker | |
| 5,269,368 | A | 12/1993 | Schneider et al. | |
| 6,140,614 | A * | 10/2000 | Padamsee | 219/438 |
| 6,311,868 | B1 | 11/2001 | Krietemeier et al. | |
| 6,362,460 | B1 | 3/2002 | Fraker | |
| 6,444,956 | B1 | 9/2002 | Witcher et al. | |
| 6,870,135 | B2 | 3/2005 | Hamm et al. | |
| 2006/0207745 | A1 | 9/2006 | Koda et al. | |
| 2006/0213205 | A1 | 9/2006 | Reverendo | |
| 2006/0239667 | A1 | 10/2006 | Young et al. | |
| 2006/0283205 | A1 | 12/2006 | Carriere | |

* cited by examiner

*Primary Examiner* — Shawntina Fuqua

(74) *Attorney, Agent, or Firm* — Baker & Daniels LLP

(57) ABSTRACT

A heat exchange apparatus including a heat exchanging portion capable of conforming to the outer surface of a heat exchange target.

11 Claims, 4 Drawing Sheets

FLUID WARMER

RELATED APPLICATION

This application claims the benefit of U.S. Provisional Patent Application No. 60/888,457, filed on Feb. 6, 2007, the entire disclosure of which is expressly incorporated by reference.

FIELD OF THE INVENTION

The present invention generally relates to a heat exchanger, and more particularly to a fluid warmer that is configured to receive containers of different sizes to warm fluid contained therein.

BACKGROUND OF THE INVENTION

A common problem with using lotions, moisturizers, oils, colloids or other liquids designed to be applied to the body, is that the liquids are sometimes cold, cool or uncomfortable when being applied. This problem is compounded when the liquid has been stored in a cold area. Another common problem with using such liquids is that when the container is relatively empty, the liquid tends to line the inside of the container instead of pooling at the bottom where most dispenser systems access the liquid.

SUMMARY OF THE INVENTION

The present invention provides a heat exchange apparatus including a bladder support configured to support a heat exchange target, a heating element supported by the bladder support, and a heat exchanging portion supported by the bladder support, the heat exchanging portion including a bladder in contact with the outer surface of the heat exchange target and adapted to conform to the outer surface of the heat exchange target.

The present invention also provides a heat exchange apparatus including a holder configured to support the heat exchange target, a bladder support supported by the holder, a heating element supported by the bladder support, and a heat exchanging portion supported by the bladder support, the heat exchanging portion including particulate in contact with the outer surface of the heat exchange target and adapted to conform to the outer surface of the heat exchange target.

The above mentioned and other features of this invention, and the manner of attaining them, will become more apparent and the invention itself will be better understood by reference to the following description of embodiments of the invention taken in conjunction with the accompanying drawings.

Figure 1:
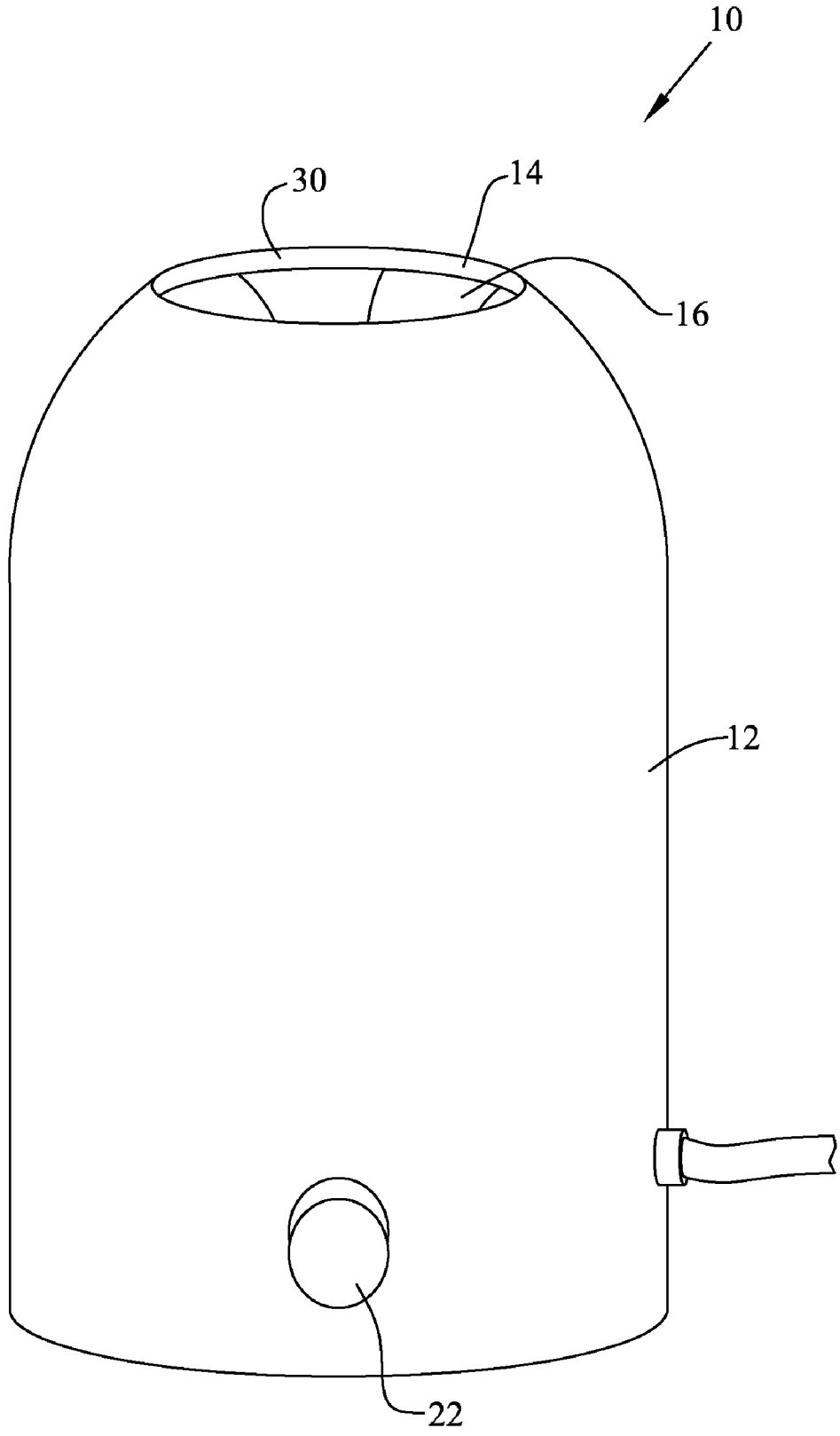
FIG. 1 is a perspective view of a fluid warmer including a bladder according to one embodiment of the present invention.

Corresponding reference characters indicate corresponding parts throughout the several views. Although the drawings represent embodiments of the present invention, the drawings are not necessarily to scale and certain features may be exaggerated in order to better illustrate and explain the present invention.

DETAILED DESCRIPTION OF EMBODIMENTS OF THE INVENTION

The embodiments disclosed below are not intended to be exhaustive or to limit the invention to the precise forms disclosed in the following detailed description. Rather, the embodiments are chosen and described so that others skilled in the art may utilize their teachings.

Figure 2:
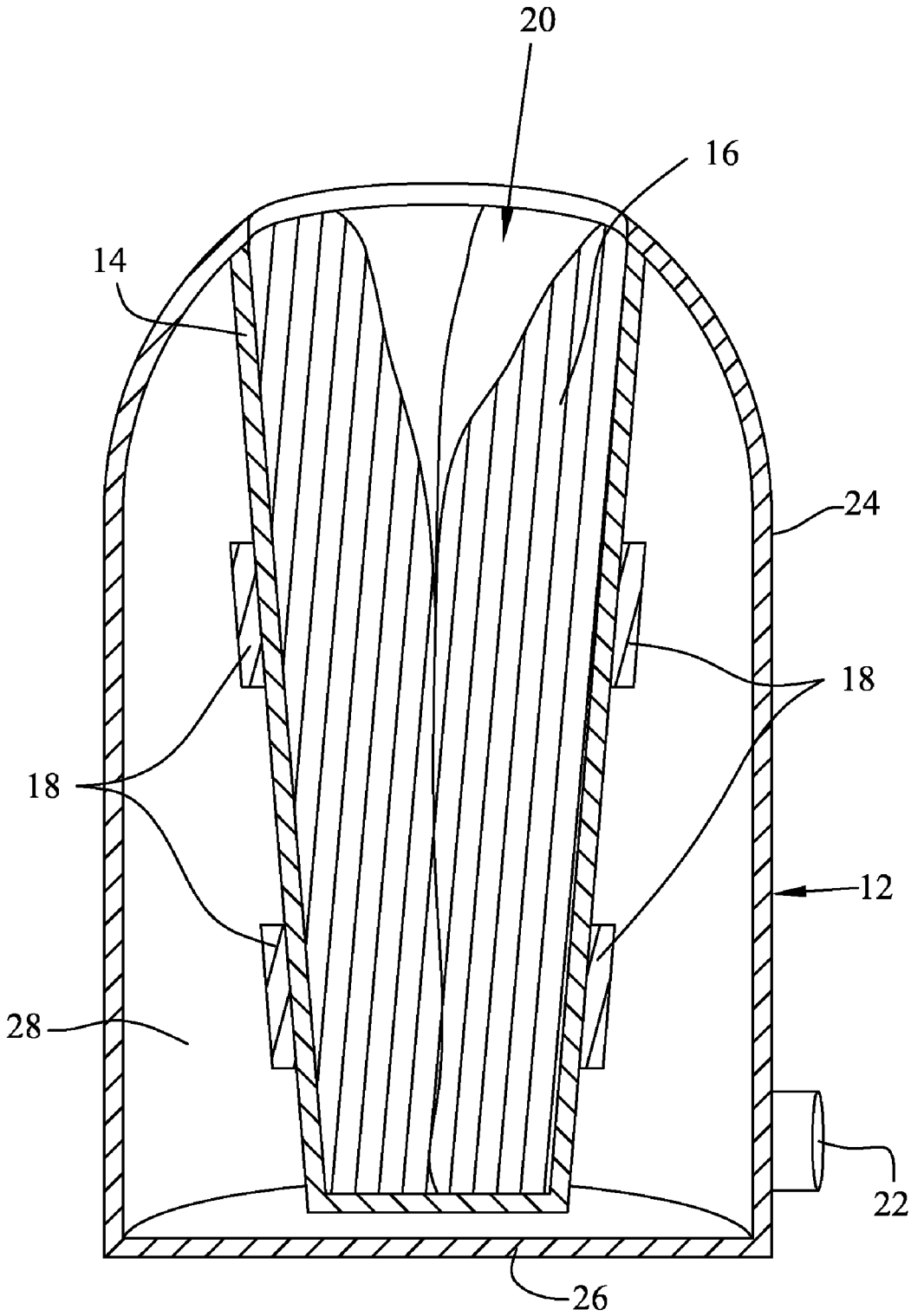
FIG. 2 is a cross-sectional view of the fluid warmer of FIG. 1.

Referring now to FIG. 1, heat transfer apparatus 10 is shown according to one embodiment of the present invention. Heat transfer apparatus 10 includes housing 12 and bladder support 14 (FIG. 2). Bladder support 14 is supported by housing 12. Heat transfer apparatus 10 optionally includes heat adjuster 22 supported by housing 12. It is understood that heat adjuster 22 could be a dial, knob, switch, remote control or any other device coupled to electronics (not shown) for controlling heating element 18 to a desired temperature.

Housing 12 defines aperture 30 exposing an opening into housing 12. As illustrated in FIG. 1, housing 12 substantially encloses bladder support 14. As described below, however, housing 12 need not substantially enclose bladder support 14. In FIG. 1, aperture 30 provides an opening into housing 12 and exposes a portion of bladder support 14.

As also illustrated in FIG. 1, housing 12 defines a substantially cylindrical shape. It should be noted that the size and shape of housing 12 is not limited to the illustration shown as housing 12 may define a wide variety of shapes and sizes.

According to one embodiment of the present invention, bladder support 14 may include bladder 16, sac 16 or any other suitable heat exchanger 16. It should be understood however that bladder 16 is not limited by a shape or size. It should also be understood that bladder 16 is not limited to a single conformation, that by deformation bladder 16 may readily change shape and conformation. Bladder 16 may include a liquid or solid with good thermal conductivity. As shown in FIG. 2, bladder 16 defines an interior space 20. It should be understood, however, that bladder 16 may be configured such that interior space 20 is only provided upon insertion of a heat exchange target.

Now referring to FIG. 2, heat transfer apparatus 10 is shown in greater detail. Housing 12 includes, among other things, housing walls 24 (shown as a single, continuous wall) and end wall 26. Housing walls 24 and end wall 26 define cavity 28. In this embodiment, bladder 16 is at least partially disposed within cavity 28. It is understood that bladder 16 need not be disposed within housing 12.

Still referring to FIG. 2, heating element 18 is described in greater detail. Heating element 18 is operably coupled to heat adjuster 22. Heating element 18 may include a thermostat, optionally a variable heat thermostat, controlled by heat adjuster 22. It should be understood that the heating element 18 is also coupled to a power source (not shown). In this embodiment, heating element 18 is shown in multiple locations. It is understood that heating element 18 is not limited to the locations illustrated. It is also understood that heating element 18 may be a single heating element part, or heating element 18 may include multiple heating element parts, as illustrated in FIG. 2. As also illustrated, heating element 18 may be adjacent to housing 12, such as housing wall 24 or end wall 26 of housing 12, or heating element 18 may be embedded within housing 12, such as within housing wall 24 or end wall 26 of housing 12 or any location within cavity 28.

Figure 4:
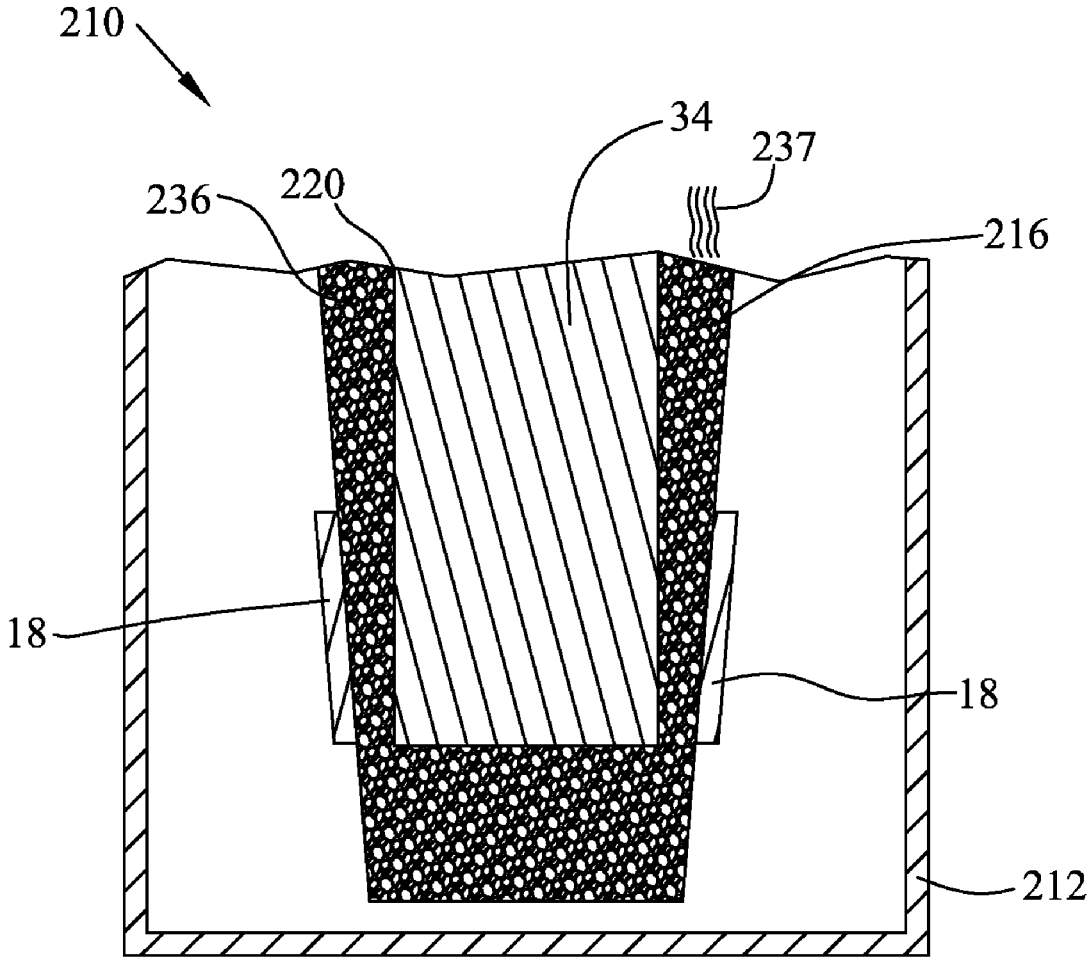
FIG. 4 is a cross-sectional view of a fluid warmer according to another embodiment of the present invention.

Aperture 30 and optionally interior space 20 are configured to accept a large variety of shapes and sizes of heat exchange target 34 (FIG. 4). Heat exchange target 34 may include a variety of different container sizes and shapes. Heat exchange target 34 may also contain a variety of different kinds of materials, including gases, liquids, and colloids such as lotions and hand creams.

Bladder 16 may include a liquid sufficiently viscous to support a heat exchange target 34. The liquid may also be sufficiently fluid to conform to different shapes of heat exchange target 34. Application of force by the user inserting heat exchange target 34 and/or heat provided by heating element 18 may assist the liquid within bladder 16 to conform to the different shapes and sizes of heat exchange target 34. Bladder 16 may also include a liquid with a low partial vapor pressure such that warming the liquid will not cause deformation of bladder 16 to maximize the surface area in contact with, and therefore the heat transfer to, heat exchange target 34. Interior space 20 or interior opening 20 also allows for bladder 16 movement and deformation.

In operation, a user places heat exchange target 34 into interior space 20 or interior opening 20 of housing 12 and adjacent to bladder 16. Bladder 16 may conform to heat exchange target 34 with or without any of the following: force from the user, heat transfer from heating element 18 and force from bladder support 14. During operation, bladder 16 remains in close and direct contact with heat exchange target 34. Bladder 16 assists in efficient heat transfer from heating element 18 to heat exchange target 34.

Figure 3:
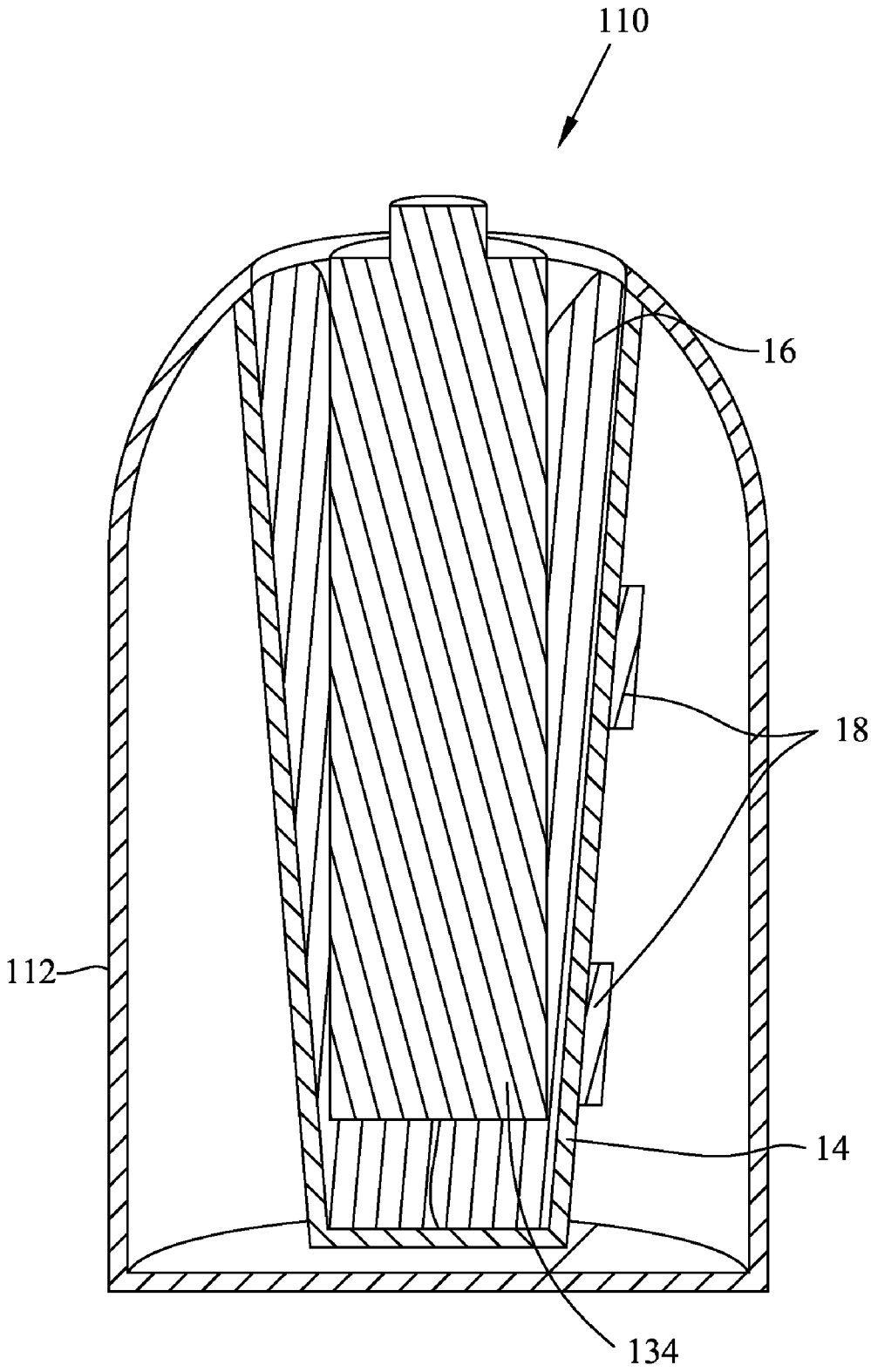
FIG. 3 is a cross-sectional view of the fluid warmer of FIG. 1 including a heat exchange target.

Now referring to FIG. 3, heat transfer apparatus 110 is shown in operation with heat exchange target 134 according to another embodiment of the present invention. Heat transfer apparatus 110 includes the same features as heat transfer apparatus 10 except for the following described differences. As illustrated in FIG. 3, housing 112 supports bladder support 14 which supports bladder 16, heat element 18, and heat exchange target 134. Heat transfer apparatus 110 operates in a similar fashion as heat transfer apparatus 10.

Referring now to FIG. 4, heat transfer apparatus 210 is shown according to yet another embodiment of the present invention. Heat transfer apparatus 210 includes the same features as heat transfer apparatus 10 except for the following described differences. As illustrated in FIG. 4, heat transfer apparatus 210 includes a housing 212 including a holder formed of particulate 216. Particulate 216 may be fluid enough to allow insertion of heat exchange target 34 into particulate 216. Particulate 216 may include good thermal conductivity, and provide an interior space that conforms to and supports heat exchange target 34. Particulate 216, similar to bladder 16, assists in efficient heat transfer to and from heat exchange target 34.

Particulate 216 may also be a sorbent for volatile, semivolatile and non-volatile substances 236. Substances 236 may be water, chemicals for fragrances or air freshening, or other desirable products. As illustrated in FIG. 4, substances 236 may vaporize as shown by wavy lines 237. Vaporization may or may not require heat transfer from heating element 18.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A heat exchange apparatus, including:

a bladder support configured to support a heat exchange target;

a heating element supported by the bladder support;

a deformable bladder positioned within the bladder support, the deformable bladder including an inner surface and an outer surface, the outer surface of the deformable bladder forming an interior space adapted to conform to the outer surface of the heat exchange target and the inner surface of the bladder forming a void with the bladder support; and a heat transfer medium positioned within the void.

2. The apparatus of claim 1, wherein the heat transfer medium is a liquid or gel.

3. The apparatus of claim 1 wherein the bladder support contains the deformable bladder and the heating element.

4. The apparatus of claim 1 further including a thermostat operably coupled to the heating element.

5. The apparatus of claim 4 wherein the thermostat is a variable heat thermostat.

6. A heat exchange apparatus, including:

a housing configured to support a heat exchange target;

a holder supported by the housing, the holder forming an interior space;

a heating element supported by the holder; and deformable particulate supported within the interior space, the deformable particulate adapted to conduct heat and to conform to the outer surface of the heat exchange target.

7. The heat exchange apparatus of claim 6, wherein the deformable particulate is a sorbent for a substance.

8. The heat exchange apparatus of claim 7, wherein the substance is a volatile or semi-volatile.

9. The heat exchange apparatus of claim 7, wherein the substance is a fragrance.

10. The heat exchange apparatus of claim 7, wherein the substance is an air-freshener.

11. The heat exchange apparatus of claim 7, wherein the substance is non-volatile.

* * * * *